United States Patent [19]

Fulks et al.

[11] Patent Number: 4,649,784

[45] Date of Patent: Mar. 17, 1987

[54] METHOD AND APPARATUS FOR SENSING ACTIVITY FOR A KEYBOARD AND THE LIKE

[75] Inventors: Robert G. Fulks, 2570 E. Georgia, Phoenix, Ariz. 85016; Robert J. Hager, Phoenix, Ariz.

[73] Assignee: Robert G. Fulks, Bedford, Mass.

[21] Appl. No.: 696,693

[22] Filed: Jan. 31, 1985

[51] Int. Cl.[4] ..... G10H 1/34

[52] U.S. Cl. ..... 84/1.1; 84/1.27; 84/DIG. 7

[58] Field of Search ..... 84/DIG. 7, 1.27, 1.1, 84/433–439; 338/69, 47, 114, 80

[56] References Cited

U.S. PATENT DOCUMENTS 4,268,815 5/1981 Evantoff et al. ..... 84/DIG. 7
4,276,538 6/1981 Evantoff et al. .
4,301,337 11/1981 Evantoff et al. .
4,314,227 2/1982 Evantoff et al. .
4,314,228 2/1982 Evantoff et al. .
4,315,238 2/1982 Evantoff et al. .
4,451,714 5/1984 Evantoff et al. .
4,489,302 12/1984 Evantoff et al. .
4,503,705 3/1985 Polchaninoff ..... 338/47

*Primary Examiner*—S. J. Witkowski
*Assistant Examiner*—David Warren
*Attorney, Agent, or Firm*—Harry M. Weiss & Associates

[57] ABSTRACT

Apparatus and method for the monitoring of the manipulation of the keys of an instrument comprises monitoring apparatus which takes the form of a pressure sensing device, associated with each key, that can be fabricated in a configuration compatible with the instrument. According to one embodiment, the pressure sensing devices can be arranged so that the monitoring apparatus can be positioned on a balance rail of a piano keyboard. In this embodiment, the monitoring configuration can be fabricated and conveniently retrofitted to a standard keyboard. The pressure sensing device comprises a resistive element, a conducting element, and a force transducer ink layer separating the resistive and conducting elements. The resistance of the resistive element is monitored and when pressure is applied to the pressure sensing device, a change in resistance can be measured. Because the resistance is a function of pressure, the amount of pressure used to activate the key can be determined.

6 Claims, 3 Drawing Figures

METHOD AND APPARATUS FOR SENSING ACTIVITY FOR A KEYBOARD AND THE LIKE

BACKGROUND OF THE INVENTION

1. Field of the Invention

This invention relates generally to musical instruments and, more particularly, to apparatus for sensing the manipulation of the musical apparatus having keys activating selected sounds or activities, such as the pianoforte, the clavichords and the like.

2. Discussion of the Related Art

It has been known in the related art to determine when a keyboard instrument such as piano, has a key or activation device manipulated by having a mechanical switching device associated with each key. The switching device, e.g. a microswitch, is responsive to the movement of the key, the movement changing microswitch contacts. The switching device suffers from several limitations. The first limitation is that the force necessary to activate the switching device can interfere with the manipulation of the keys of the instrument and provide a different responsiveness or "feel" to an operator of the associated key. Secondly, switching devices do not conveniently provide information with respect to the pressure by which the key has been activated.

Other methods of sensing the manipulation of the components of a keyboard or similar type of instrument includes coupling springs to the individual keys. The springs are associated with a sensing device and the sensing device can indicate to a controller the motion of the key. Other sensors can be coupled to the instrument components that produce the sound or activity activated by the keys. These transducers can indicate not only activation of a particular component, but with related complex apparatus, such as an optical sensing instrument, can indicate the force which the component has been activated.

These techniques for determining the manipulation of a keyboard are expensive and typically require elaborate implementation either during the manufacture of the musical instrument and an equal or greater effort to retrofit the sensing device in the musical instrument.

A need has therefore been felt for a sensing device for keys of a piano keyboard, or similar type instrument, to determine when the key is manipulated and the force with which the key is. In addition, a need was felt for a sensing device that can detect the manipulation of the keys of a keyboard and similar apparatus that is capable of being conveniently retrofitted to existing instruments.

SUMMARY OF THE INVENTION

It is therefore an object of the present invention to provide a method and apparatus for determining if a key in a keyboard or similar instrument has been manipulated.

It is a further object of the present invention to provide method and apparatus for determining the force with which a key on a keyboard or similar instrument has been activated.

It is yet another object of the present invention to provide a method and apparatus for sensing the manipulation of the keys that can be conveniently retrofitted to existing pianos and similar instruments.

It is yet another object of the present invention to provide a pressure sensing element that can be used with each key of a musical instrument keyboard to determine when the key has been manipulated.

It is a still further object of the present invention to provide a resistive element and a conducting element separated by a force transducer ink and a change in resistance coupled to the keys of the keyboard that is caused when pressure is applied to the key.

The aforementioned and other objects are accomplished, according to the present invention, by a plurality of pressure sensing devices, each of the pressure sensing devices associated with a key of the musical instrument. The pressure sensing devices can be constructed of a pair of electrodes coupled to a planar resistive area typically located on the interior surface of the first insulating material. A second insulating material has a conducting region generally with the dimensions of the planar resistive element on an interior surface and a layer of force transducer ink covering the resistive element. The two insulating materials are positioned in such a manner that the force transducer ink layer separates the conducting region from the resistive element. The pressure sensing device is then coupled to the musical instrument key so that when the key is activated, a force is transmitted to the pressure sensing device.

In a preferred embodiment for use with a piano, the pressure sensing element is placed on the balance rail of the keyboard of a piano with the felt pad placed over the pressure sensing element and the piano key placed thereon. The guide pin positioning and guiding the piano key can pass through the pressure sensing device. The felt pad, normally present to muffle unwanted sounds, serves to distribute the force more uniformly over the area of the force transducer ink. In this manner, the manipulation of the piano key can be identified by a change in resistance and, because the resistance of the pressure sensing ink is a function of pressure, the force with which the key has been struck can be determined from the resulting resistance.

These and other features of the present invention will be understood upon reading of the following description along with the figures.

DESCRIPTION OF THE PREFERRED EMBODIMENT

Detailed Description of the Figures

Figure 1:
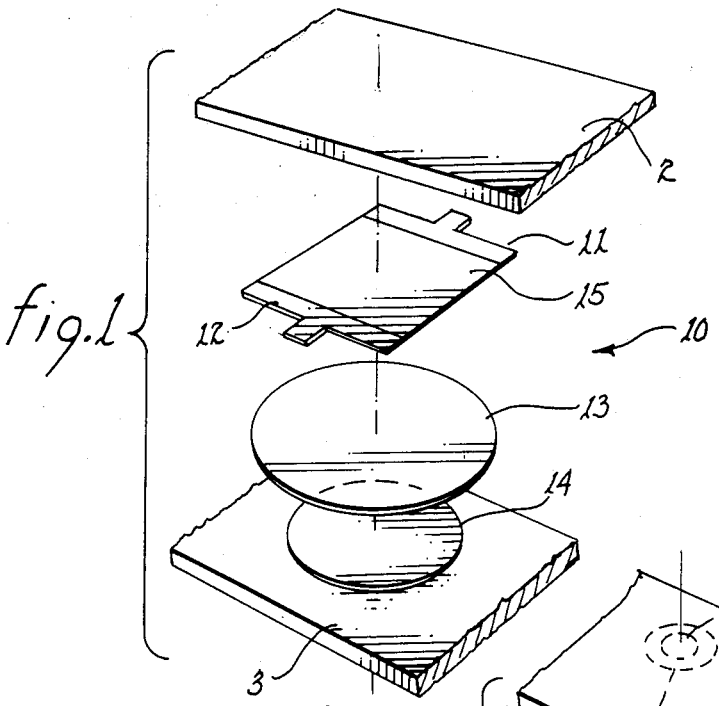
FIG. 1 is an exploded view of the pressure sensing device utilized in the present invention.

Referring to FIG. 1, a single pressure transducer element 10 of the type utilized in monitoring activity of a key according to the present invention is shown. In this embodiment, a resistive region 15 deposited on an insulating material 2. The resistive region 15 has electrodes 11 and 12 deposited on the insulating material 2 and coupled electrically to the resistive region. On a second insulating material 3, a conductive region 14 is deposited and a layer of force transducing ink is deposited thereon. The two insulating materials 2 and 3, are positioned in such a manner that the force transducer ink layer 13 separates the conducting region 14 from the resistive region 15.

Force transducer ink is a known, commercially available substance which has the property wherein as pressure is increased to a layer of the substance its resistivity decreases. U.S. Pat. No. 3,503,031 describes a pressure-sensitive ink or "paint".

Figure 2:
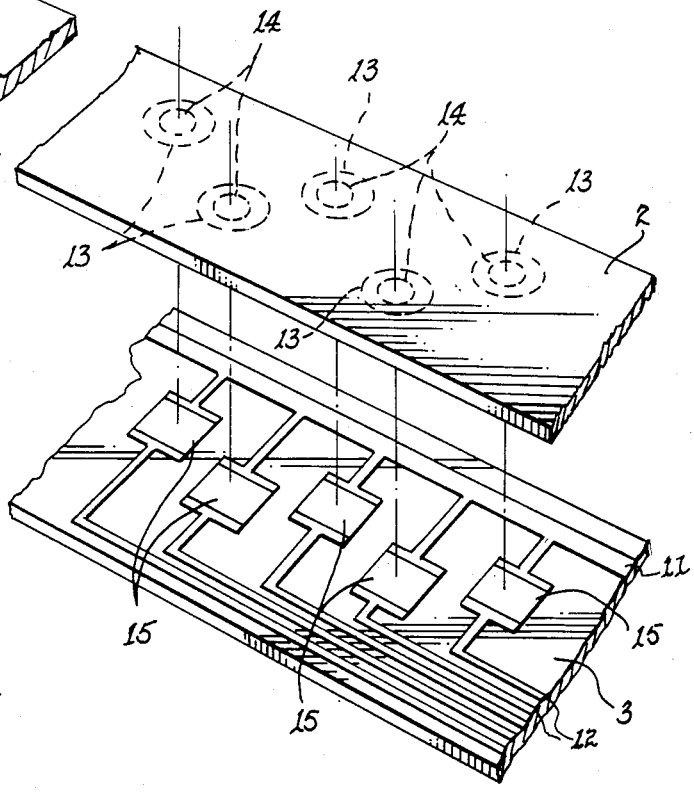
FIG. 2 is an illustration of a plurality of pressure sensing device capable of being utilized with a musical keyboard.

Referring next to FIG. 2, a configuration with a plurality of pressure sensing elements is shown. On an insulating material 2, a plurality of pressure sensing devices has associated therewith a plurality of resistive regions 15, each resistive region having a conducting electrode 11 and a conducting electrode 12 electrically coupled thereto. Positioned on a second insulating material 3 are conducting regions 15 and regions with a layer of force transducer ink 13 applied over the conducting region. When the two insulating materials, 2 and 3, are positioned in contact with one another, each conducting regions 14 is, generally, in close physical proximity to an associated resistive regions 15. However, the conducting regions 14 and the associated resistive regions 15 are separated by the layer 13 of force transducer ink.

Figure 3:
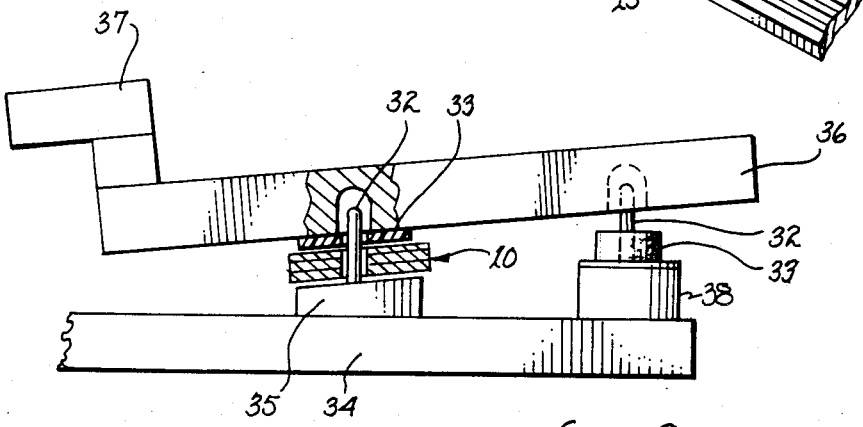
FIG. 3 is a cross-sectional view of the pressure sensing device as positioned in a musical keyboard.

Referring next to FIG. 3, a cross-section of a piano keyboard showing the operation of a single key is shown. The keyboard has a key bed 34, for supporting the keys. Coupled to the key bed 34 are a balance rail 35 and a key stop 38. The balance rail 35 and the key stop 38 have guide pins 32 coupled thereto. The guide pins 32 engage cavities in the key 36 and partially define the motion of the key when struck. In a quiescent position, key 36 is balanced on the balance rail 35 and is at its fartherest distance from key stop 38. When the key 36 is manipulated, the key moves toward key stop 38 and action 37 is activated.

The frequency or pitch component mechanism of the instrument is determined by the action 39. For many musical instruments such as the piano, the force with which key 36 is driven toward key stop 38 determines the loudness or intensity of the generated sound. The piano key is separated from the balance rail 35 by (felt) pad 33 and is free to pivot about the guide pin coupled to the balance rail 35. Similarly, the guide pin 32 coupled to key stop 38 helps limit the lateral motion of the key 36. The felt pad 33 is also used with the keystop 38 to prevent contact with the keyboard structure and minimize extraneous sounds.

To this generalized keyboard configuration, the pressure sensing element 10 is added. In the preferred embodiment, the pressure sensing element 10 is positioned so that the individual pressure sensing devices are located beneath the (felt) pad 33 associated with the balance rail. When the key 36 is forced down to activate with the sound generating device (not shown) by means of the action, the pressure is transmitted through the felt pad which serves to distribute the pressure uniformly to the pressure sensing device. Thus, the activation of a key 36 can be reflected in the change in resistance of a particular pressure transducer element in the multiplicity of pressure transducer elements.

Operation of the Preferred Embodiment

The manipulation of a musical key can be determined by the change in resistance of a pressure sensitive element of the type illustrated in FIG. 1. The manipulation and the consequent change in resistance can not only indicate manipulation of the key, but, because the change in resistance of the pressure sensing device is determined by the amount of pressure, the force with which the instrument key is activated can be determined. Thus it is possible to monitor the operation of the keys of a musical instrument or similar device and to determine the extent and the progression of the manipulation of the keys.

The pressure on the force transducer ink layer 13 causes a decrease in resistance in portions of the layer experiencing the force. This change in resistance provides a path or paths coupling the resistive layer and the conducting layer (14). When the resistance between the electrodes (i.e. conducting regions 11 and 12) has an appropriate value, the change in resistance of the force transducer ink produces a change in the resistance as measured between terminals coupled to the conducting regions. In addition, the change in resistance can be a function of the force exerted on the key.

It will be clear that the pressure sensing devices of the instant invention can be conveniently retrofitted to keyboards with a standard placement of the guide pins on the balance rail. In the preferred embodiment, the pressure sensing devices have the guide pins extending roughly through the center of the pressure sensing device 10. An important advantage of the location of the guide pins through the pressure sensing devices is the distribution of force over an extended area of the devices, especially when the (felt) pads 33 are employed. To the extent that, for a group of pianos, the position of the guide pins of the balance rail has a relatively constant configuration, then a monitoring device with a plurality of pressure sensing devices can be fabricated and can be retrofitted by placing the monitoring device on the balance rail. No new construction is necessary for this type of device retrofit.

The position of the pressure sensing devices has been described as being located on a monitoring device. The monitoring device can be an elongated plastic material with the pressure sensing device fabricated on interior sides of an insulating material. It will be clear that all components of the pressure sensing device can be deposited on one sheet of insulating material or even on the balance rail itself, providing the balance rail is constructed of an appropriate material. Furthermore, the pressure sensing devices can be positioned in close proximity to the guide pins associated with the key stop 38 rather than with the balance rail 35.

The pressure sensing device of the instant invention can be used with any type of musical key that is manipulated, even keys for which a binary activation is present, i.e. the loudness/strength of the resulting sound is controlled by another mechanism such as the breath for wind instruments. It will be clear that although the instant invention is described in terms of a musical instrument, any switch or key activated mechanism can be monitored, or can be used to control the resulting sound/activity resulting from manipulation of the keys.

The above description is included to illustrate the preferred embodiment and is not meant to limit the scope of the invention. The scope of the invention is to be limited only by the following claims. From the above description, many variations will be apparent to one skilled in the art that would yet be encompassed in the spirit and scope of the invention.

What is claimed is:

1. Apparatus for determining activity of a musical instrument comprising:

a keyboard, said keyboard comprising a plurality of keys and a balance rail supporting said keys; and a pressure sensing device associated with each of said keys, said pressure sensing device providing a change in resistance when said associated key has a force applied thereto, said pressure sensing device is positioned between said keys and said balance rail.

2. The apparatus for determining activity of a musical instrument of claim 1 wherein said change in resistance is determined by the force applied to said associated key.

3. The apparatus for determining activity of a musical instrument of claim 1 wherein said pressure sensing device comprises:

a resistive element;

a conductive element; and a layer of force transducer ink position between said resistive element and said conductive element.

4. Apparatus for determining activity of a musical instrument of claim 1 further including means for distributing a force between each said key and said balance rail more uniformly over said associated pressure sensing device.

5. Apparatus for determining activity of a musical instrument of claim 4 wherein a plurality of said pressure sensing devices can be positioned on a keyboard monitoring means, said monitoring means being positioned on said balance rail.

6. The method of detecting motion of a key of a musical instrument, said musical instrument comprising a keyboard having a plurality of keys positioned on a balance rail, said method comprising the steps of: p1 positioning a pressure sensing device on said balance rail to be activated upon manipulation of at least one of said keys, said pressure sensing device comprising a planar resistive element, a planar conducting element, and a layer of force transducer ink between said conducting element and said resistive element; and detecting a change in resistance of said pressure sensing device when said at least one key is manipulated.

* * * * *